United States Patent [19]

Kulakow

[11] Patent Number: 4,831,761

[45] Date of Patent: May 23, 1989

[54] GUN MAGAZINE AND SPRING ASSEMBLY

[76] Inventor: Eric M. Kulakow, 6315 Lake Athabaska Pl., San Diego, Calif. 92119

[21] Appl. No.: 205,231

[22] Filed: Jun. 9, 1988

[51] Int. Cl.[4] ..... F41C 25/02
[52] U.S. Cl. ..... 42/50
[58] Field of Search ..... 42/7, 18, 22, 50

[56] References Cited

U.S. PATENT DOCUMENTS

| | | | |
|---|---|---|---|
| 1,044,983 | 11/1912 | Brown | 42/18 |
| 1,307,492 | 6/1919 | Hammond | 42/50 |
| 3,377,732 | 4/1968 | Bivens | 42/50 |
| 3,440,751 | 4/1969 | Fremont | 42/50 |
| 3,443,334 | 5/1969 | Ardolino | 42/50 |
| 3,453,762 | 7/1969 | Fremont | 42/50 |
| 3,603,020 | 9/1971 | Wiese | 42/50 |
| 3,619,929 | 11/1971 | Fremont | 42/50 |
| 3,726,038 | 4/1973 | Bredbury | 42/50 |
| 3,964,199 | 6/1976 | Musgrave | 42/50 |
| 4,139,959 | 2/1979 | Howard et al. | 42/50 |
| 4,430,821 | 2/1984 | Vincent | 42/50 |
| 4,472,900 | 9/1984 | Howard | 42/50 |
| 4,495,720 | 1/1985 | Bross | 42/50 |
| 4,614,052 | 9/1986 | Brown et al. | 42/87 |

FOREIGN PATENT DOCUMENTS

| | | | |
|---|---|---|---|
| 647847 | 7/1937 | Fed. Rep. of Germany | 42/50 |
| 776859 | 11/1934 | France | 42/50 |
| 489150 | 7/1938 | United Kingdom | 42/50 |

*Primary Examiner*—Charles T. Jordan
*Attorney, Agent, or Firm*—Charmasson & Holz

[57] ABSTRACT

In a telescopically extensible ammunition magazine for a firearm or similar device in which the rounds of ammunition are biased toward the firing chamber, by a coil spring, bent leaf spring or similar resilient device, a tensioning cord partially compresses a section of the spring preventing full extension of that section and causing the spring to snake and rub against the inside of the magazine or magazine assembly. The partially snaking spring is allowed to frictionally and incrementally travel within the magazine during reloading keeping each round properly aligned as each one is inserted. The extended length of the spring is selected to provide the minimum spring extension needed to feed the final unit of ammunition to the firing chamber when the magazine is collapsed to its minimum length. Ammunition can thus be conveniently loaded without having to compress the spring; yet the full strength of the spring is available to bias the rounds towards the firing chamber. Ammunition can be easily manually unloaded from the magazine.

17 Claims, 3 Drawing Sheets

GUN MAGAZINE AND SPRING ASSEMBLY

FIELD OF THE INVENTION

This invention relates to firearms or other similar shooting devices, more specifically to magazines and telescoping magazines which supply bullets or other ammunition to the firing or shooting chamber.

BACKGROUND OF THE INVENTION

The primary objectives of a firearm magazine are to: (1) store ammunition; (2) supply ammunition to the firing chamber; and (3) provide a means to reload the magazine with additional ammunition. The magazine should be as relatively small for a given amount of ammunition so that it will not interfere with operation of the firearm. It should also be light weight, rugged in construction, and low in cost. When the magazine is used in each of the three modes (storing, feeding, and reloading), a minimum of effort to convert from one mode to another mode is also desirable.

Many current gun magazines have a duct like body holding the ammunition or bullets, a base plate attached to one end of the body opposite the firearm interface, and a feeding spring in contact with the bottom-most plate. Many magazines include a follower at the spring-/ammunition interface to assist compression load distribution and feeding or stripping of the ammunition to the firing chamber.

Most of the current firearm magazines may operate well in one of these modes, but in other modes, very poorly. In the first mode, the objective is to store as many rounds of ammunition as possible in a given space. This space may be inside the firearm handle, in replaceable canisters or clips, or within certain envelope limitations. The storage container should protect the ammunition from adverse environmental impacts. Springs, followers and walls for impact protection can reduce available space for storage.

The second mode requires a mechanism to move the ammunition towards the firing chamber and sequentially force rounds to the top of the magazine to be stripped off by the bolt. This is typically accomplished with a relatively stiff feeding spring (i.e.: a high spring constant which, when compressed, can apply large loads on the ammunition to force it to the top of the magazine. If rapid firing is desired, spring force may require further modification.

The final mode of operation, reloading may be accomplished while the magazine is attached to the firearm on some firearms. More commonly, reloading is accomplished with the magazine detached from the firearm. A large manual effort is normally required to compress the stiff spring within the magazine. A special loading tool is sometimes used. This manual effort is particularly difficult if the user is chilled, fatigued or tense.

In many cases, the manual reloading force is greater than can be exerted by a significant portion of the users, preclude manual loading by these users. Even if the user is capable of the manual effort required, the task may result in injury or at least sore, tired fingers and pain unless carefully accomplished, especially when many magazines are to be loaded. Another problem may occur when a magazine is taken apart for cleaning, typically by sliding off the base plate. The spring can shoot out, injuring the user. The most common approach to some of these problem is the use of a tool or reloading device. Magazine reloading tools and devices tend to be complex and cumbersome. Some loading tools are very simple, but they take time to attach and use and must work against full spring pressure. They may also limit convenient transport, access and use of the firearm.

In another approach to achieve good multi-mode performance, a telescoping magazine is employed. This allows a portion of the magazine to be extended during reloading, relieving some or all of the force in the spring. This allows reloading without some or all of the compression required. Once loaded, the telescoping magazine is then collapsed, re-applying spring force to feed ammunition to the firing chamber. Examples of telescoping magazines are illustrated in U.S. Pat. Nos. 1,044,983 and 4,472,900.

Other approaches, sometimes in conjunction with telescoping magazines, are the use of various spring guides, stops or notches as part of the duct-like magazine body. These provide lateral support for the spring during compression or expansion, and may prevent the spring from erratic motions during reloading or feeding thus jamming the magazine or firearm. One example is illustrated in U.S. Pat. No. 3,726,038.

Still another approach has been to use adjustable springs. These can vary the spring forces during reloading and feeding. They can be used in fixed or telescoping magazines. Examples of adjustable spring magazines are illustrated in U.S. Pat. Nos. 3,964,199 and 3,443,334.

No prior art spring biased magazine the applicant is aware of allows manual storage or reloading without some spring compression force. Telescoping magazines minimize this compression (most of the compression is typically accomplished during closing telescopic motions), but does not eliminate it.

What is needed is a biasing or spring device which can repeatedly supply force to feed the ammunition to the firing chamber, without the need for complex guides or magazine protrusions, requires minimal storage space, prevents spring from loss and shooting out during cleaning and requires little or no significant spring compression force during reloading, thus speeding manual reloading and precluding the need for special loading tools.

SUMMARY OF THE INVENTION

The principal and secondary objects of the invention are:

To provide a control of spring motions independent of magazine geometry;

To provide a limit to spring expansion;

To allow ease of unloading;

To allow reloading of the magazine without significant spring compression; and

To prevent loss and shooting out of unattached spring during magazine stripping.

These and other objects are achieved by a tension element attached to each end of a magazine spring and extending through the middle of the spring, which keeps at least part of the spring in compression and precludes its full extension. It also induces spring bowing and buckling. The contact between the partially compressed and snaking spring and the inside of the magazine causes the spring to frictionally slide down the magazine during reloading. The maximum extension of the spring is selected to provide the minimum spring extension necessary to feed the final unit of ammunition to the firing chamber. The spring compression can be provided by collapsing the telescoping magazine after attachment to the firearm, rather than during the reloading of ammunition.

DESCRIPTION OF THE PREFERRED EMBODIMENT

Figure 1:
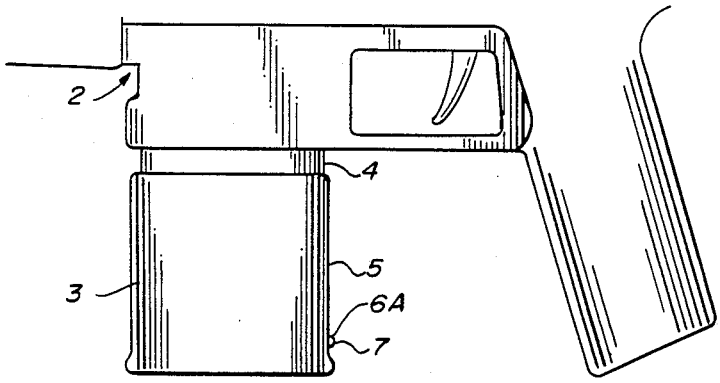
FIG. 1 is a partial side view of a firearm with an attached magazine in the feeding mode.

Referring now to the drawing, there is shown in FIG. 1 a firearm equipped with the preferred embodiment of a telescoping magazine 3. The rifle or firearm 2 is supplied with ammunition or bullets from within the magazine 3. The magazine 3 can be detached from the firearm 2 to allow access for reloading ammunition.

Figure 2:
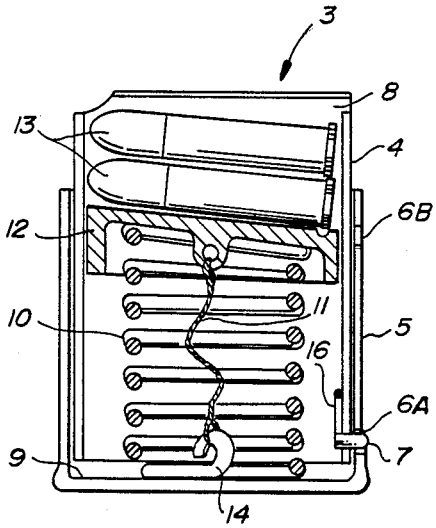
FIG. 2 is a cross-sectional view of the magazine.

FIG. 2 shows the internal mechanism of the magazine with only two bullets remaining to be fired. The magazine 3 is comprised of a main body 4 releasably attached to the firearm 2, and a telescopic extension 5. The main body 4 is duct-shaped and generally rectangular in cross section. The extension 5 has the same general shape, but is slightly larger to allow the interior of the extension 5 to slide on the exterior surface of the main body 4. The telescoping arrangement of the extension 5 allows variation in assembled dimension along the major axis of the magazine. The ports 6A and 6B drilled in the back wall of the extension 5 can accept the prong 7 resiliently mounted on the inner back wall of the magazine main body 4 by a leaf spring or other flexible resilient material 16. This alternate attachment of the tongue 7 in two positions provides for two primary length configurations of the magazine assembly 3. Other ways of locking could also be used for the telescoping magazine and are known. The spring assembly described can be used with this type of magazine, independent of the locking means used. An alternate configuration of a magazine would retain the bullets or ammunition in a staggered position or other position (ie: bullets not all in the same plane as shown in FIG. 2), or positioned in an arcurate magazine (stacking of bullets form and are contained within non-planar walls of the magazine). These alternate embodiments do not alter the basic function of the invention as herein described.

The spring or bias element 10 is prevented from extending beyond the general dimensions of the main body 4 by a pliable and flexible cord, cable, chain or tension element 11 which is attached at one end to the follower 12 which crowns the spring 10, or to a loop at top of the spring. The other end is attached to a loop 14 formed at the base of the spring. When fully extended, but restrained by the cord 11, the spring 10 places the follower 12 proximate to the interface end 8 of the main body 4 of the magazine. The spring 10, if the cord 11 were not present would be generally helical in shape. Being partially compressed by cord 11, the spring tends to bow if not constrained by the magazine, exerting snaking pressure and forcing portions of the spring into rubbing contact with the interior of the main body 4 and during reloading the interior of extension 5. In other configurations, additional guides may be required for the cord yoke and spring, especially when used in a magazine with arcurate or non-planar walls, but these will be functionally equivalent to the preferred embodiment. In still another configuration, the spring and cord assembly could be restrained within the magazine by limiting the size of the magazine ports or attaching the cord or spring to the magazine. This type of restraint would prevent the spring from being ejected during maintenance or unloading.

Figure 3:
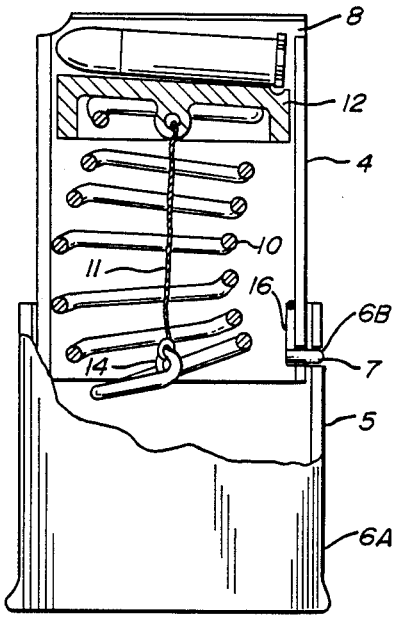
FIG. 3 is a partial cross sectional view of a nearly empty, extended magazine.

When the empty magazine is extended before reloading as illustrated in FIG. 3, the snaking pressure of spring 10 retains the spring in the main body 4. As bullets are inserted through the top opening and pushed against the follower 12, the snaking spring offers only a small frictional resistance as it slides down the extended magazine rubbing against the inner wall. This slight resistance is sufficient, however, to prevent the follower 12 from dropping freely down the magazine under the weight of the ammunition being loaded. The spring with snaking pressure and already loaded bullets move down by a small increment as the next bullet is inserted. This mode of operation keeps the bullets in proper alignment during the loading process without offering undue resistance to their sequential insertion. Further, the loading resistance can remain constant, not increasing as in the prior art. The distal part of the spring 10 reaches the bottom 9 of the extension 5 with the insertion of the last bullet that can be held by the main body 4 and still allow space for the compressed spring and follower when the system is closed. The magazine can now be mounted on the firearm 2. As the telescopic extension 5 is pushed back, over the main body 4, the spring 10 is compressed against the follower 12, biasing the ammunition toward the firing chamber.

Figure 4:
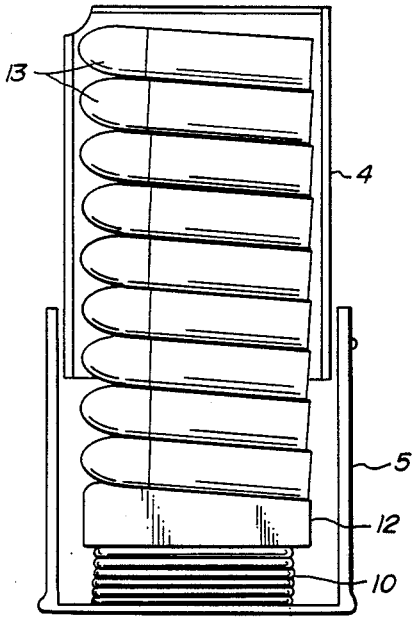
FIG. 4 is a cross sectional view of the magazine extended and fully loaded with an extra charge of ammunition.

FIG. 4 is a cross sectional view of the extended magazine 3 fully loaded with additional ammunition rounds 13. This can be a storage position or an extended magazine feeding mode. It should be noted that the spring 10 is completely compressed after contact with bottom reacting surface 9 is made, allowing for the insertion of an extra load of ammunition into the extended magazine. After about half of the rounds of ammunition are used, the extended magazine can be shortened in length by collapsing the extension and again recompressing spring 10 to bias the remaining bullets towards the firing chamber. If added rounds from the extended position are less important to the user than ease of reloading, only the number of rounds that would fit inside the shortened magazine would be reloaded. It should be understood that the telescoping extension which in this embodiment is formed by element 5 could include a plurality of telescoping members in order to increase the length and/or capacity of the magazine or allow sufficient magazine extension when the firearm design doesn't allow single full length sleeve type magazines to be used.

Figure 5:
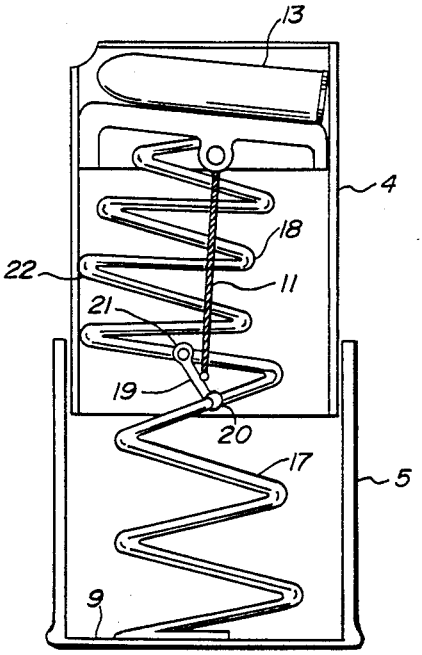
FIG. 5 is a cut-away side view of a magazine exposing an alternate embodiment of a sectioned spring.
Figure 6:
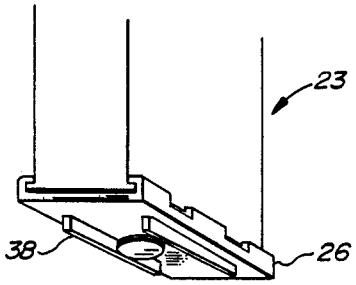
FIG. 6 is a perspective view of the lower section of an alternate embodiment of the invention.
Figure 7:
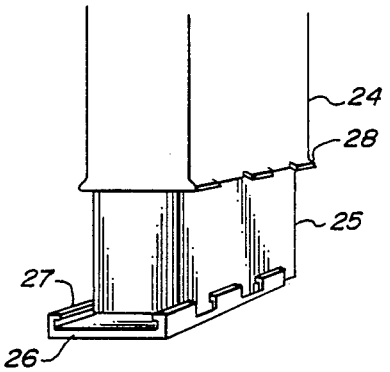
FIG. 7 is a perspective view of the alternate embodiment in the expanded mode.
Figure 8:
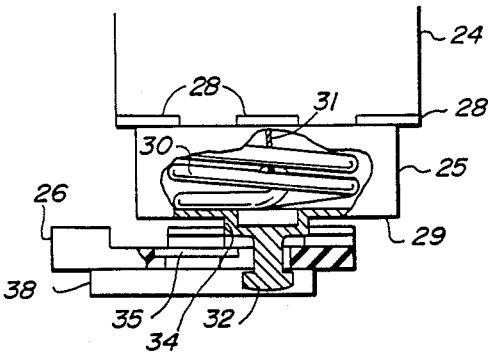
FIG. 8 is a partially cut-away side view of the locking plate.
Figure 10:
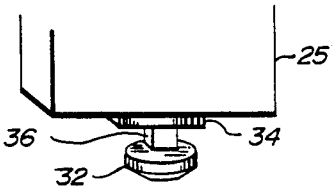
FIG. 10 is a perspective view of the lower part of the magazine extension.
Figure 9:
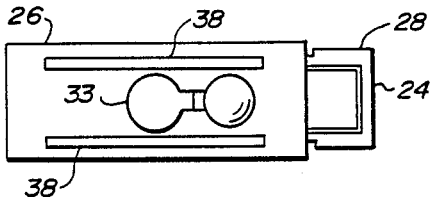
FIG. 9 is a bottom plan view of the locking plate.
Figure 11:
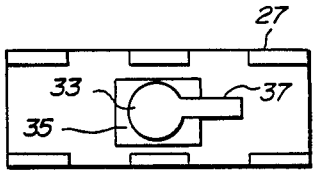
FIG. 11 is a top plan view of the locking plate.

FIG. 5 illustrates an alternate configuration of the spring assembly in a partially reloaded position. An extra length of spring 17 is provided free of any restrain by cord 11. The lower end of the cord 11 is attached to a yoke 19 which spans two diametrically opposite points 20 and 21 of a coil in the mid section of the spring. The spring sections (upper and lower) could also have indentations which retain the yolk properly positioned at all times. The upper half 18 of the spring acts in the same manner as the previously described version. It may also be made to snake in order to provide friction points, such as shown at 22 against the interior wall of the magazine. FIGS. 2, 3, and 5 exaggerate the space on either side of the spring and bowing of the spring for clarity, as the magazine walls would more closely contain the spring and any resulting spring distortion. The lower, unrestrained part 17 of the spring provides additional limited resistance against the insertion of bullets. In this configuration, the follower will always return to the top of the magazine regardless of magazine geometry. The loaded bullets compress only the lower weaker spring section as well as translate the upper section 18 until the amount of bullets corresponding to the capacity of the main body 4 have been loaded. The low end of the spring 10 could be secured to reacting surface 9. The lower spring section has a spring constant significantly less than the upper spring section since it is not required to supply the high forces of moving ammunition to the top of the magazine for feeding/supply to the firing chamber. The spring segments are shown attached to each other but attachment is not required.

FIGS. 6 through 11 illustrate an alternate embodiment 23 of the extensible magazine. The extension 25 is normally contained within the main body 24. In the compressed configuration the two sections are locked together about their bases by a plate 26 which is loosely attached to the bottom of extension 25 by a headed shaft 36 engaged through an opening 33 in the center of the plate 26. A series of lateral grooves 27 formed by flanged projections along the edges of the locking plate 26 are sized and positioned to slidingly engage a series of mating tongues 28 along the lower rim of the main body 24. The ammunition biasing spring 30 and retaining cord 31 are similar in nature and function as the ones in the first-described embodiment of the invention. However, the invention would also function in combination with a conventional spring assembly. The base 34 of the headed shaft 36 forms a rectangular protrusion which fits into a similarly dimensioned mating cavity 35 in the locking plate 26 when the main body 24 and extension 25 are locked together. Pressing the button 32 at the end of the shaft 36 against the spring 30 moves the rectangular protrusion 34 out of its nesting cavity 35, freeing the plate 26 which can now be shifted into the disengaged position shown in FIGS. 7, 8 and 9. The slot 37 which extends at the right of the opening 33 catches the square shaft 36 as the plate moves to the left, preventing any rotational movement of the plate. A pair of parallel barriers 38 on opposite sides of the button 32 guard against inadvertent depression of the button and release of the locking plate by rubbing action during handling of the firearm.

While the preferred embodiment of the invention has been shown and described, changes and modifications may be made therein within the scope of the appended claims without departing from the spirit and scope of this invention.

What is claimed is:

1. A magazine and spring control assembly in combination with a shooting device having a firing chamber which can accept ammunition and a firing chamber loading port, said assembly comprising:

a generally duct-shaped magazine having a primary dimension along said duct axis, said magazine capable of attachment to said shooting device at a mounting orifice of said duct axis and capable of containing at least one round of ammunition;

a compression bias device loosely placed within said magazine, having an active end proximate to said mounting orifice and a reacting end distal from said active end, said bias device being placed and dimensioned to be compressed by said ammunition and to produce an extension bias force capable of moving said round along said primary dimension to said mounting orifice; and a tension member attached between two distal points of said bias device along said axis, said tension member being dimensioned to limit extension of said bias device between said two points.

2. The assembly as claimed in claim 1, wherein said magazine comprises:

a first duct shaped section attached at a first end to said shooting device proximate to said firing chamber port, said first section having cross sectional dimensions perpendicular to the major axis of said duct shape sufficient to pass said round to said firing chamber port;

at least one other overlapping duct shaped section slidingly attached to said magazine, having said cross sectional dimensions generally similar to said magazine, said other duct shaped section capable of slidingly varying said primary dimension of said magazine;

a reacting member attached to the end of said other duct section distal from said shooting device, said reacting member capable of supporting and reacting against compression forces of said bias element; and means for releasably retaining said other magazine sections to each other and to said magazine in at least two positions having different primary dimensions.

3. The assembly claimed in claim 1, wherein said magazine comprises;

a first duct-shaped section having said mounting orifice attached to the firing chamber loading port, said first section having cross sectional dimensions perpendicular to said duct axis sufficient to pass said round to said firing chamber port;

at least one other duct-shaped section telescopically attached to said first section opposite said orifice, said other duct-shaped section being positioned to adjustably expand the major axis dimension of said magazine;

a reacting member attached to the end of said other duct-shaped section distal from said shooting device, said reacting member capable of supporting and reacting against compression forces of said bias device; and means for releasably retaining said other magazine section to said first magazine section in at least two positions defining different primary dimensions of said magazine.

4. The assembly as claimed in claim 3, wherein said tension element has a maximum length generally equal to the dimension along said major axis of said first magazine section.

5. The assembly as claimed in claim 4, wherein said means for retaining comprises a tongue element attached to said first section protruding into an opening in a side of said other section.

6. The assembly as claimed in claim 5, wherein said retaining means is released by manually depressing on said tongue.

7. The assembly as claimed in claim 4, wherein said bias device element is a coiled spring.

8. The assembly as claimed in claim 7, wherein said tension member is a flexible pliable cord.

9. The assembly as claimed in claim 7, wherein said tension member is a chain.

10. The assembly as claimed in claim 7, wherein said tension member is a cable.

11. The assembly as claimed in claim 8, wherein said reacting member closes the distal end of said other duct shaped section.

12. The assembly as claimed in claim 11, wherein said second section slidingly overlaps said other section.

13. The assembly as claimed in claim 11, wherein said first section slidingly overlaps said other section.

14. The assembly claimed in claim 13, wherein said means for releasably retaining comprise:

a locking plate movably attached to the distal end of said other section;

said locking plate having lateral flanges forming a plurality of grooves; and a plurality of projections extending from the distal end of said first section, said projections being shaped and positioned to engage said grooves in a locking position of said plate.

15. A magazine and spring control assembly in combination with a shooting device having a firing chamber which can accept ammunition and a firing chamber loading port, said assembly comprising:

a generally duct-shaped magazine having a primary dimension along said duct axis, said magazine capable of attachment to said shooting device at a mounting orifice of said duct axis and capable of containing at least one round of ammunition;

a compression bias device loosely placed within said magazine, having an active end proximate to said mounting orifice and a reacting end distal from said active end, said bias device being placed and dimensioned to be compressed by said ammunition and to produce an extension bias force capable of moving said round along said primary dimension to said mounting orifice; and a tension member attached between two distal points of said bias device along said axis, said tension member being dimensioned to limit extension of said bias device between said two points, wherein said tension member is positioned and dimensioned to distort said section of the bias device into a bowing structure which frictionally contacts the inner wall of said magazine.

16. The assembly claimed in claim 15, which also comprises a follower capping said active end of said bias device, said follower shaped and dimensioned to distribute compression bias device loads to over a significant portion of said round external surfaces and guide said round to said firing chamber loading port.

17. A magazine and spring control assembly in combination with a shooting device having a firing chamber which can accept ammunition and a firing chamber loading port, said assembly comprising:

a generally duct-shaped magazine having a primary dimension along said duct axis, said magazine capable of attachment to said shooting device at a mounting orifice of said duct axis and capable of containing at least one round of ammunition;

a compression bias device placed within said magazine, having an active end proximate to said mounting orifice and a reacting end distal from said active end, said bias device being placed and dimensioned to be compressed by said ammunition and to produce an extension bias force capable of moving said round along said primary dimension to said mounting orifice; and a tension member attached to two distal points of said bias device along said axis, said tension member being dimensioned to limit the extension of said bias device between said two points.

* * * * *